US005601358A

United States Patent [19]

Chien

[11] Patent Number: 5,601,358

[45] Date of Patent: Feb. 11, 1997

[54] UNIVERSAL POWER PACK

[76] Inventor: Tseng L. Chien, 8F. No. 29, Alley 73, Lin Shen Street, Shi-Chi Town, Taipei, Hseng, Taiwan

[21] Appl. No.: 522,124

[22] Filed: Aug. 31, 1995

[51] Int. Cl.[6] ..... F21L 7/00

[52] U.S. Cl. ..... 362/190; 362/367; 362/84; 362/800; 362/806; 362/226; 248/911

[58] Field of Search ..... 362/190, 367, 362/800, 806, 84, 226; 40/544, 550; 248/911, 912, 558

[56] References Cited

U.S. PATENT DOCUMENTS

| | | | |
|---|---|---|---|
| 2,572,760 | 10/1951 | Rikelman | 36/1 |
| 2,634,407 | 4/1953 | Johnson | 340/321 |
| 3,153,745 | 10/1964 | Gurian et al. | 315/206 |
| 4,774,642 | 9/1988 | Janko et al. | 362/108 |
| 4,895,110 | 1/1990 | LoCascio | 119/106 |
| 4,901,210 | 2/1990 | Hanabusa | 362/106 |
| 4,949,228 | 8/1990 | Lin et al. | 362/72 |
| 5,067,063 | 11/1991 | Granneman et al. | 362/156 |
| 5,151,678 | 9/1992 | Veltri et al. | 340/321 |
| 5,245,516 | 9/1993 | de Haas et al. | 362/108 |
| 5,245,517 | 9/1993 | Fenton | 362/156 |
| 5,249,106 | 9/1993 | Barnes et al. | 362/108 |
| 5,327,329 | 7/1994 | Stiles | 362/61 |
| 5,327,587 | 7/1994 | Hurwitz | 2/422 |
| 5,406,724 | 4/1995 | Lin | 36/137 |

FOREIGN PATENT DOCUMENTS

| | | |
|---|---|---|
| 0166534 | 1/1986 | European Pat. Off. . |
| 2221025 | 1/1990 | United Kingdom . |

*Primary Examiner*—James C. Yeung
*Assistant Examiner*—Alfred Basichas

[57] ABSTRACT

A power pack having compartments for holding at least one battery and electrical components for controlling at least one lighting element includes a snap-on cover having any of a plurality of configurations for enabling the power pack to be assembled to a wide variety of surfaces and, optionally, electrical terminal structures for mounting a variety of different lighting elements, including both electro-luminescent strips and light emitting diode fixtures, directly to the power pack.

11 Claims, 3 Drawing Sheets

UNIVERSAL POWER PACK

BACKGROUND OF THE INVENTION

1. Field of the Invention

This invention relates to a power pack having provision for mounting both a "super-thin" lighting element of the type described in U.S. patent application Ser. No. 08/432,707, filed May 2, 1995, and a light emitting diode (LED) on a wide variety of surfaces and objects.

2. Discussion of Related Art

Copending U.S. patent application Ser. No. 08/432,707, filed May 2, 1995, and entitled "Super-Thin Lighting Arrangement For A Moving Object," discloses a lighting arrangement for moving objects of the type consisting of a movable base and a main object, such as roller skates, ice skates, and skate boards having a number of uniquely advantageous features, many of which are incorporated into the present invention.

The first of these features has to do with mounting of the lighting controlled by the power pack in a variety of different parts of the moving object, to enhance the attractive of the objects and, in the case where the object is to be worn, protect the wearer by making the wearer more visible to motorists. The larger the area of the lighting elements, the greater the visibility of the object and the wearer, and the greater the possibility of creating attractive designs when the lighting elements are lit. As a result, the copending "moving object" application provides for including lighting both on the moving base, which could take the form of a roller or ice skate bracket, and on the main object itself, which could take the form, for example, of the boot of a roller or ice skate. Basically, this is the feature of universality, i.e., of being able to provide illumination of more than one surface, although the prior application did not extend the feature of universality to beyond different parts of the object.

The second feature has to do with the fact that while electro-luminescent and other super-thin lighting elements can by themselves result in an attractive and advantageous lighting arrangement, as discussed at length in the copending application, other types of lighting elements may still be useful even in contexts where super-thin lighting elements are also used, and thus the copending application discloses the concept of including on the same object both super-thin lighting elements, such as electro-luminescent (EL) or photo-luminescent (PL) strips, and also LEDs, although the disclosure with respect to the use of alternative types of lighting elements is very general, and no specific structure therefor is disclosed except a brief mention of the possibility of molding light bulbs into the boot of a roller or ice skate.

The third feature of the arrangement disclosed in the copending application and utilized or improved upon in the present application has to do with modularity and ease of assembly. In particular, the copending application discloses a unique design for mounting the EL strips to the power pack by providing terminals on the outside of the pack to which different shaped lighting element support brackets could be mounted. This design results in an integral power pack lighting fixture which can have a variety of shapes and which is extremely simple to install, allowing the user to easily vary the shape of the lighting fixture.

The present invention builds upon these features of universality (in terms of both the surfaces to which the lighting arrangement can be mounted and the type of lighting element) and modularity/ease of assembly to provide a universal power pack suitable for use in a wide variety of applications beyond those disclosed in the copending application.

One of the principal problems solved by the present invention is that, while the power pack design disclosed in the copending application provides excellent lighting coverage and versatility, it is ill-suited for the different surfaces of the moving object, leaving few options for placement of the power pack, and requiring wires to be run for extended distances from the power pack to the various lighting elements on the-different parts of the object.

In addition, the present invention extends the concept of a lighting fixture mountable to the housing of the power pack via conductive mounting posts to LED containing fixtures. This results in a truly modular design in which numerous different lighting designs, including EL and LED based lighting designs, can easily be mounted on the same basic housing, with the basic housing being easily adaptable for a wide variety of different surfaces and objects.

At this point, it should be noted that the copending application is by the same Inventor as the present application, and therefore is not prior art, either by law or admission. Instead, the present invention is an improvement over the novel power pack design of the copending application. While it is especially suitable for the type of moving object disclosed in the copending application, the design principles involved appear to have much broader applicability than just moving objects of the type described in the copending application.

SUMMARY OF THE INVENTION

It is accordingly an objective of the invention to provide a power pack design which can be used on a variety of surfaces and which is capable of mounting both superthin lighting elements and LEDs or other types of lighting element using a single basic housing design, and which therefore provides a truly "universal" power pack for a variety of lighting elements.

It is a further objective of the invention to provide a universal power pack design suitable for use in connection with an illuminated moving object of the type described in U.S. patent application Ser. No. 08/432,707, herein incorporated by reference, and which includes provision for replacement of batteries in the power pack.

These objectives are achieved, in accordance with a preferred embodiment of the invention, by providing a power pack having compartments for holding at least one battery and electrical components for controlling at least one lighting element, an arrangement for directly mounting the power pack to a variety of lighting elements, and a snap-on cover having any of a plurality of configurations of enabling the power pack to be assembled to a wide variety of surfaces.

DETAILED DESCRIPTION OF THE PREFERRED EMBODIMENTS

Figure 1:
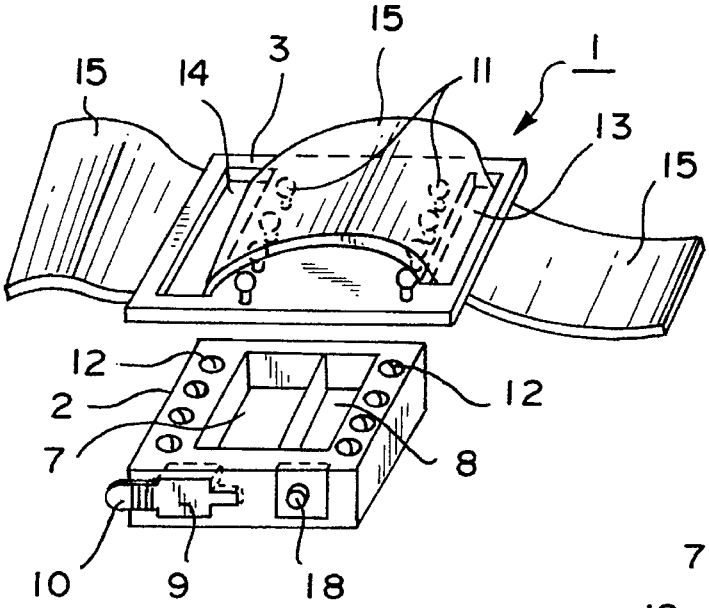
FIGS. 1–4 are perspective views of a universal power pack constructed in accordance with the principles of a preferred embodiment of the invention, and having four different optional cover configurations.

FIGS. 1–4 illustrate a power pack 1 made up of a base housing 2 and four different cover configurations 3–6. Housing 2 is made of plastic and includes two interior compartments 7 and 8, one of which houses at least one battery (not shown), and the other of which houses power supply and control circuitry 19 (shown only in FIG. 6).

The electrical circuitry could take the form of an analog electro-luminescent element control circuit, such as is described in the above-mentioned U.S. patent application Ser. No. 08/432,707, or it could include an integrated circuit controller of the type disclosed in the Inventor's copending application Ser. No. 08/518,594, filed on Aug. 11, 1995, and entitled "Driver/Control Circuit For A Super-Thin Lighting Element". In fact, it is intended that the power pack of the present invention could be used with any control circuit suitable for converting power supplied by a battery, solar cell, or other self-contained power source, to either an LED or an electro-luminescent strip, including control circuits that generate special effects such as sequential flashing or chasing, random flashing, steady state lighting, fade-in fade-out effects, and so forth.

As illustrated in FIGS. 1–4, housing 2 includes, in addition to interioricompartments 7 and 8, a hinged door 9 having a latch 10 extending therefrom to facilitate user access to the battery compartment when the cover is attached, and an opening through which an on/off switch 18 can be caused to extend for manually turning the lighting circuitry on and off from the outside of the housing. Those skilled in the art will appreciate that door 9 can take a variety of forms other than a hinged or pivotal door, and can extend from the housing or be mounted flush therewith as desired. In addition, provision can be made for slidable rather than pushbutton switches, and for more than one switch, light sensor type switches, or no switch at all.

Each of covers 3–6 is preferably mounted to the housing by means of a press-fit arrangement made up of posts 11 depending from the cover and openings 12 in the housing, the openings 12 having a slightly smaller diameter than the posts 11 to provide an interference fit when the posts are inserted into the openings. While this arrangement is especially simple and convenient, however, those skilled in the art will appreciate that numerous other cover mounting arrangements could be substituted therefor, including hook and catch snap-on type arrangements, tape, screws, or any other permanent or non-permanent fastening arrangement, including sealing arrangements for providing protection of electrical components contained in the housing from environmental conditions.

Figure 2:
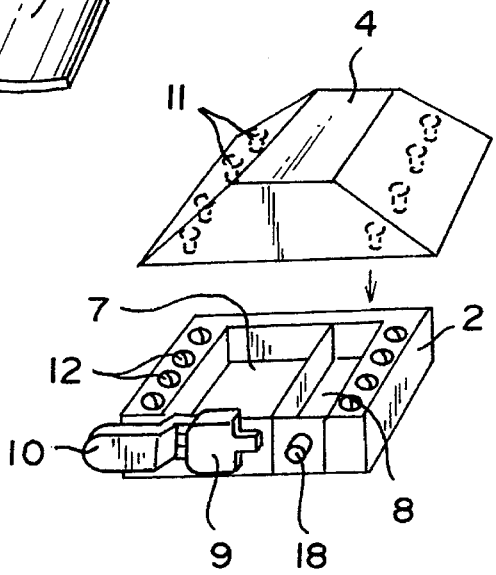
Figure 3:
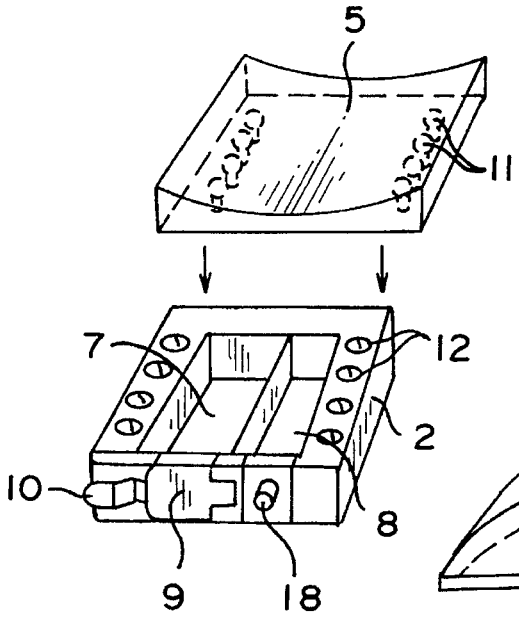
Figure 4:
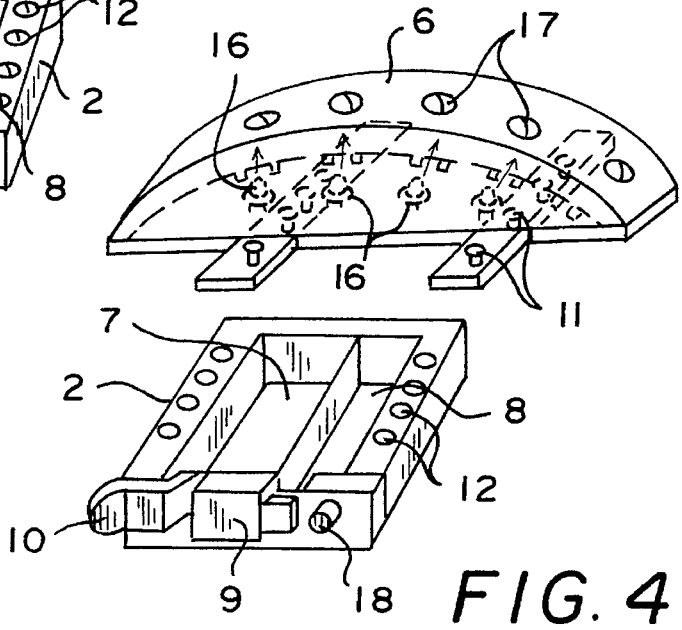

The four cover options illustrated in FIGS. 1–4 are, more specifically, a strap compatible cover 3, shown in FIG. 1, a cover 4 with a narrowed top, shown in FIG. 2, a cover 5 with a concave top, shown in FIG. 3, and a cover 6 with a convex top and provision for mounting a plurality of LEDs 16 through openings 17 extending therethrough. The strap compatible cover 3 includes two openings 13 and 14 through which the belt or strap 15 of a boot, for example, can be inserted such that the power pack is supported by the strap or belt 15 or 16, while the narrow and concave top covers 4 and 5 are designed to be adhered or mounted on respective narrow and convex surfaces, and convex cover 6 is arranged to provide an added light support rather than to be mounted on a surface, with the possibility of either providing a circuit board in the cover 6 for LEDs 16, connecting the LEDs by wires to circuitry in compartment 8, or connecting the LEDs to the main circuitry in compartment 8 by making the posts 11 conductive and providing conductive material in the openings 12.

Those skilled in the art will appreciate that while four distinct covers are illustrated in FIG. 1–4, numerous additionalcover shapes are possible, depending on the nature of the object with which the power pack is to be used, and that the cover need not necessary be on "top" of the housing, but rather for example could be on the top and bottom, or on any side which provides access to the interior "compartments" so that circuitry and battery terminals may be installed therein.

Figure 5:
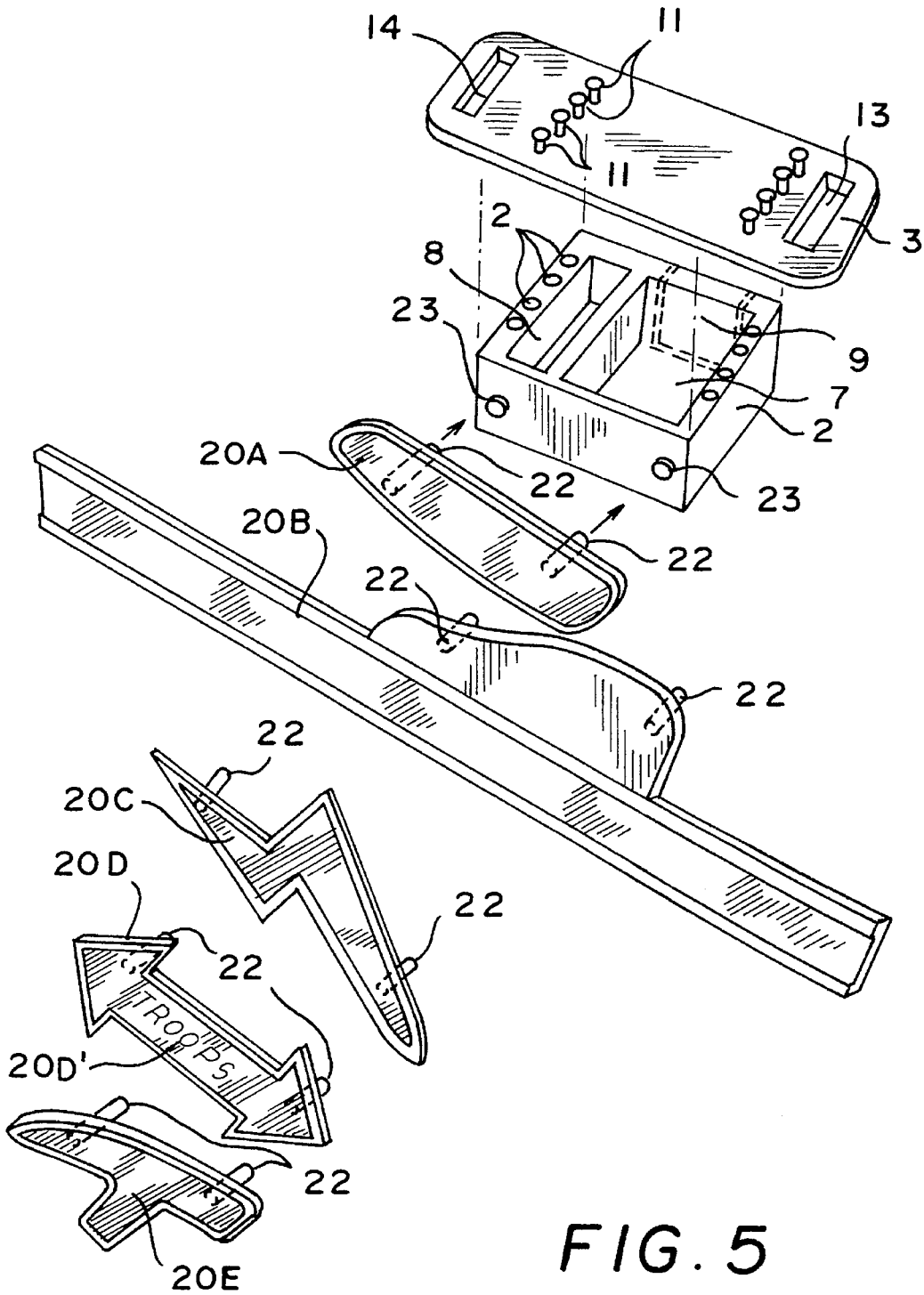
FIG. 5 is a perspective view of a universal power pack also constructed in accordance with the principles of the invention and five different lighting elements which could be mounted thereto.

As shown in FIG. 5, the universal power pack of the embodiment of the invention shown in FIGS. 1–4 may include provision for directly mounting a plurality of different lighting elements thereto, preferably in "snap-on" form. Although illustrated as including a cover similar to cover 3, those skilled in the art will appreciate that any of the other covers illustrated in FIGS. 1–4, or any of the other cover possibilities mentioned above, may be used with the preferred housing 2.

As in the implementation illustrated in FIGS. 1–4, the housing shown in FIG. 5 includes the two compartments 7 and 8, one for the battery including an access door or gate 9, and one for the electric circuitry, but this implementation does away with the need for wires to at least one of the lighting elements controlled by circuitry in the housing by providing on a lighting fixture 20A–20E to be mounted on the housing two "posts" in the form of terminals 21 prewired to pass through the housing to the appropriate power supply circuitry.

The use of a combination mounting post/terminal arrangement permits mounting of EL strips or other lights on the power pack itself, in the manner described for example in the above-mentioned copending U.S. patent application Ser. No. 08/432,707. Those skilled in the art will appreciate from FIGS. 5 and 6 the flexibility which this design provides, since one can easily change the shape of the lighting means by simply snapping a different one of holders fixtures 20A–20E, all of which have different shapes and one of which includes printing 20D', into terminal openings 23 on the side of the housing 2.

Figure 6:
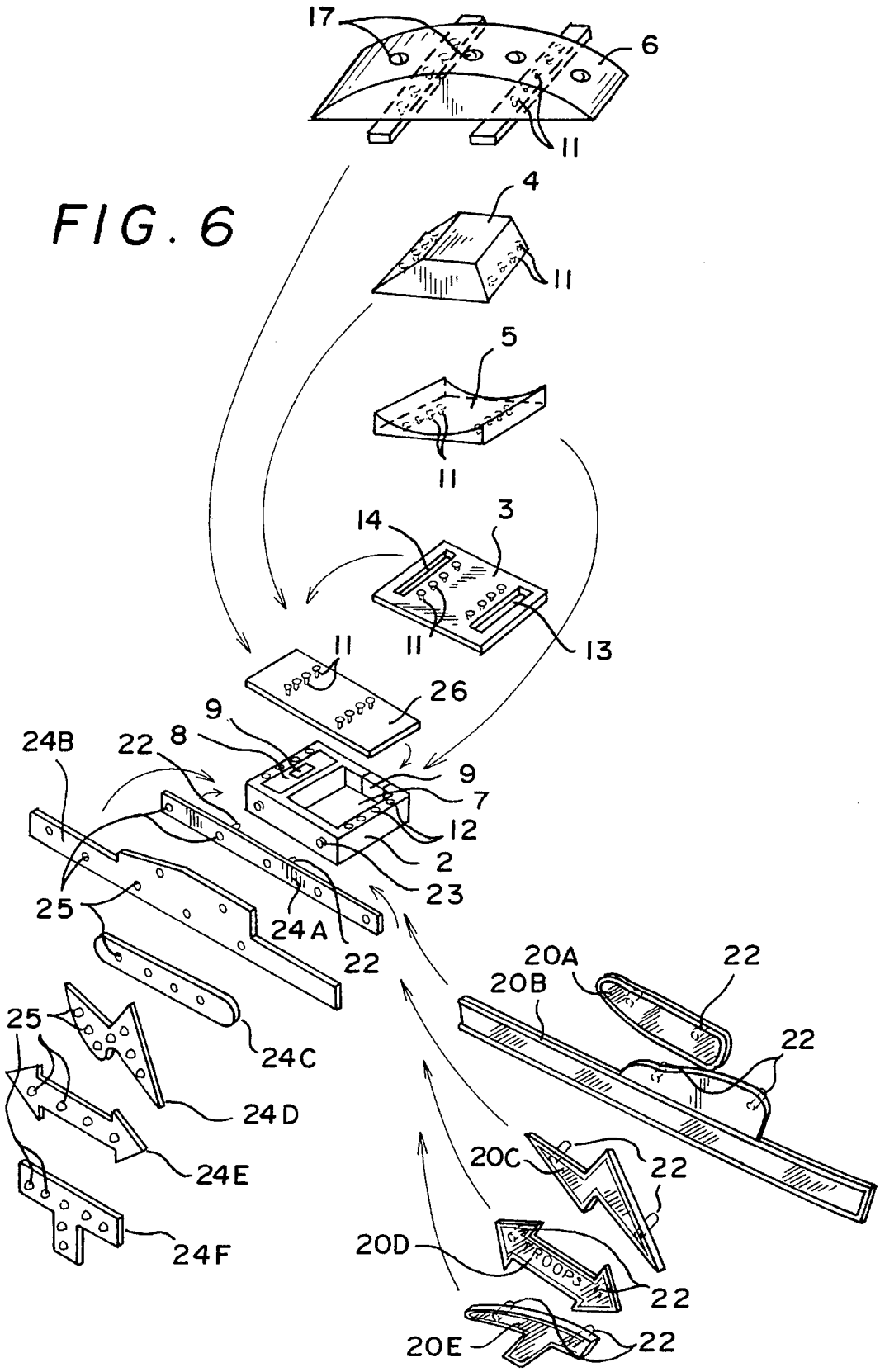
FIG. 6 is a perspective view of a power pack having five different cover configurations and nine different lighting elements.

While FIG. 5 illustrates a plurality of lighting fixture arrangements 20A–20E particularly suitable for mounting EL light strips, a particular advantage of the present invention is that LED lighting fixtures 24A–24F having a variety of shapes and including various patterns of LEDs 25 can also easily be mounted thereon. FIG. 6 illustrates an arrangement which can be used with any of the four covers illustrated in FIGS. 1–4, as well as other cover shapes including a flat cover 26, and with a plurality of different shapes of LED mounting fixtures as well as with the different EL fixtures shown in FIG. 5.

Those skilled in the art will appreciate that the power requirements of LEDs and EL strips are different, that provision either for separate terminals or for switching circuitry would need to be made before substituting LED elements for EL strips, and further that while different shapes of LED fixture may be freely substituted for each other, LED fixtures may not necessary be substituted for EL fixtures. Nevertheless, with appropriate circuitry, the basic housing design can be used for both LED and EL fixtures, as well as incandescent or fluorescent light fixtures, resulting in a truly universal power pack design which can be mounted on a wide variety of surfaces and objects to give a wide variety of lighting effects.

Having thus described a preferred embodiment of the invention and a number of different variations and modifications of the preferred embodiment, it is anticipated that still further variations and modifications will undoubtedly occur to those skilled in the art upon reading the above description, and it is therefore intended that the invention be interpreted, in accordance with the appended claims, to cover all such variations and modifications which fairly fall within the scope of the invention.

I claim:

1. A universal power pack, comprising:

a housing having compartments for a battery and electrical lighting element control circuitry;

at least two housing covers; and mounting means for alternatively mounting the at least two housing covers to the housing one at a time such that each of the at least two housing covers is a replacement for remaining ones of the at least two housing covers, wherein said at least two housing covers have different shapes, thereby enabling said housing to have different configurations for mounting to a variety of different surfaces and objects.

2. A power pack as claimed in claim 1, wherein said mounting means comprises corresponding openings and mounting posts arranged to be interference fit into said openings.

3. A power pack as claimed in claim 2, wherein said posts depend from each of said covers and said openings are in said housing.

4. A power pack as claimed in claim 1, wherein said covers have surfaces selected from the group consisting of narrowed surfaces, concave surfaces, and convex surfaces, thereby enabling the power pack to be mounted on narrowed surfaces, convex surfaces, and concave surfaces.

5. A power pack as claimed in claim 1, wherein one of said covers includes means for receiving a strap and thereby mounting the power pack on the strap, while another of said covers lacks means for receiving the strap, so that the power pack can be either mounted on the strap or on surfaces and objects others than the strap.

6. A power pack as claimed in claim 1, wherein said housing includes terminal openings arranged to receive conductive members extending from lighting element mounting fixtures of various shapes and thereby directly mount the fixtures on the housing while at the same time electrically connect lighting elements on the fixtures to said electrical circuitry in the housing.

7. A power pack as claimed in claim 6, wherein said lighting elements are electro-luminescent strips.

8. A power pack as claimed in claim 6, wherein said lighting elements are light emitting diodes.

9. A power pack as claimed in claim 6, wherein said terminal openings are arranged to receive terminals extending from both an electro-luminescent strip and a light emitting diode.

10. A power pack as claimed in claim 1, wherein said housing includes a door arranged to enable the user to access the battery compartment.

11. A power pack as claimed in claim 1, including an opening through which extends a manual pushbutton on/off switch for the lighting element control circuitry.

* * * * *